US005263634A

United States Patent [19]

Korine

[11] Patent Number: 5,263,634

[45] Date of Patent: Nov. 23, 1993

[54] SAFETY CARTON FOR PIZZA AND SIMILAR ARTICLES

[76] Inventor: Gil J. Korine, 15 Sandra Dr., Dix Hills, N.Y. 11746

[21] Appl. No.: 993,436

[22] Filed: Dec. 21, 1992

[51] Int. Cl.[5] ..... B65D 5/20

[52] U.S. Cl. ..... 229/109; 229/120; 229/150; 229/178; 229/906

[58] Field of Search ..... 229/109, 110, 120, 149, 229/150, 152, 178, 902, 906, DIG. 14; 426/115, 128, 129, 130

[56] References Cited

U.S. PATENT DOCUMENTS

| | | | |
|---|---|---|---|
| 3,478,950 | 11/1969 | Stevens | 229/182.1 |
| 3,512,697 | 5/1970 | Robinson | 229/902 |
| 4,362,265 | 12/1982 | Williams | 229/109 |
| 4,765,534 | 8/1988 | Zion et al. | 229/906 |
| 4,919,326 | 4/1990 | Deiger | 229/109 |
| 4,984,734 | 1/1991 | Zion et al. | 229/109 |
| 4,993,625 | 2/1991 | Stease et al. | 229/109 |
| 5,000,374 | 3/1991 | Deiger | 229/109 |
| 5,071,062 | 12/1991 | Bradley et al. | 229/109 |
| 5,110,039 | 5/1992 | Phillips | 229/906 |

FOREIGN PATENT DOCUMENTS

| | | | |
|---|---|---|---|
| 3933372 | 4/1991 | Fed. Rep. of Germany | 229/109 |

OTHER PUBLICATIONS

"Octagonal Pie Carton" published by Product Development Dept., Rathon Corp., Dec. 1953.

*Primary Examiner*—Gary E. Elkins
*Attorney, Agent, or Firm*—Richard L. Miller

[57] ABSTRACT

A safety carton for pizza or the like is provided which consists of a rear wall that is hinged for connecting bottom and top panels together. The bottom and top panels each having rounded corners. Two opposed side walls and a fold over front wall are connected to and extend upwardly from the bottom panel. A pair of rear diagonal corner walls and a pair of front diagonal corner walls are each connected at one end to each side wall. A closure structure is connected thereto for selectively maintaining the top panel in a closed position.

4 Claims, 1 Drawing Sheet

SAFETY CARTON FOR PIZZA AND SIMILAR ARTICLES

BACKGROUND OF THE INVENTION

The instant invention relates generally to food product containers and more specifically it relates to a safety carton for pizza and similar articles Numerous food product containers have been provided in the prior art that are adapted to protect the food products therein, such as pizza, bakery goods and the like, that are sold for carryout use. For example, U.S. Pat. Nos. 4,765,534 to Zion et al.; 4,913,340 to Ilitch; 4,919,326 for Deiger; 4,979,667 to Seaman; 4,984,734 to Zion et al.; 4,993,625 to Stease et al. and 5,000,374 to Deiger all are illustrative of such prior art. While these units may be suitable for the particular purpose to which they address, they would not be as suitable for the purpose of the present invention as hereafter described.

SUMMARY OF THE INVENTION

A primary object of the present invention is to provide a safety carton for pizza or the like that will overcome the shortcomings of the prior art devices.

Another object is to provide a safety carton for pizza or the like that includes diagonal corner walls and a top panel, having inner side flaps with tabs to engage with the pizza or the like in the carton to prevent shifting thereof.

An additional object is to provide a safety carton for pizza or the like constructed from a blank having rounded corners of a substantially continuous sheet of durable material, which when folded and assembled will form the carton without sharp pointed corners with which a user can be inadvertently injured.

A further object is to provide a safety carton for pizza or the like that is simple and easy to use.

A still further object is to provide a safety carton for pizza or the like that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
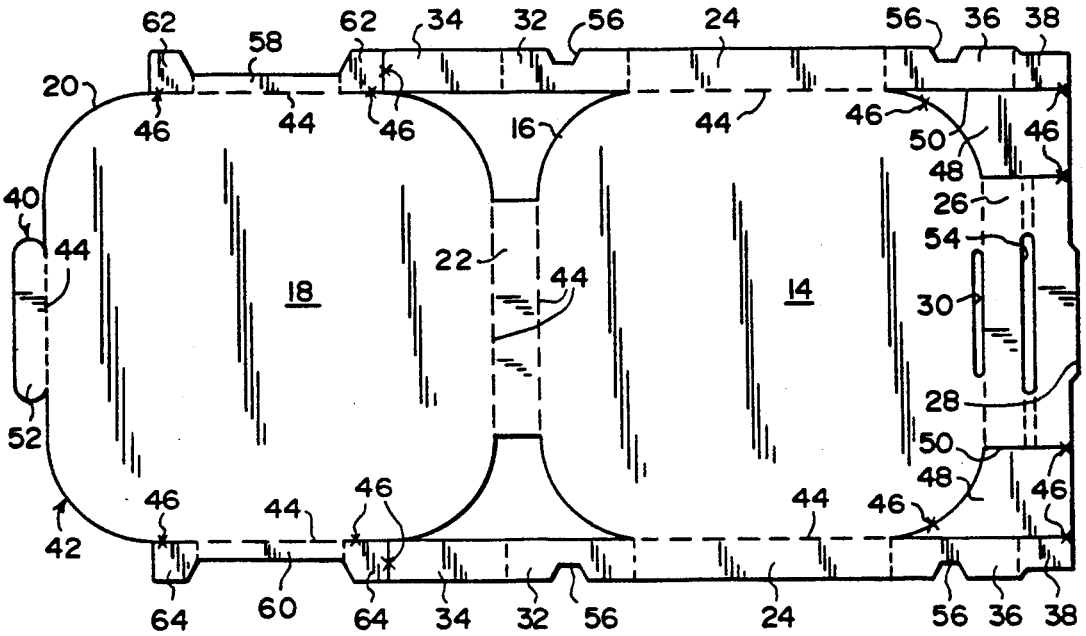
FIG. 1 is a plan view of a blank that is cut and scored and used to produce the instant invention.
Figure 2:
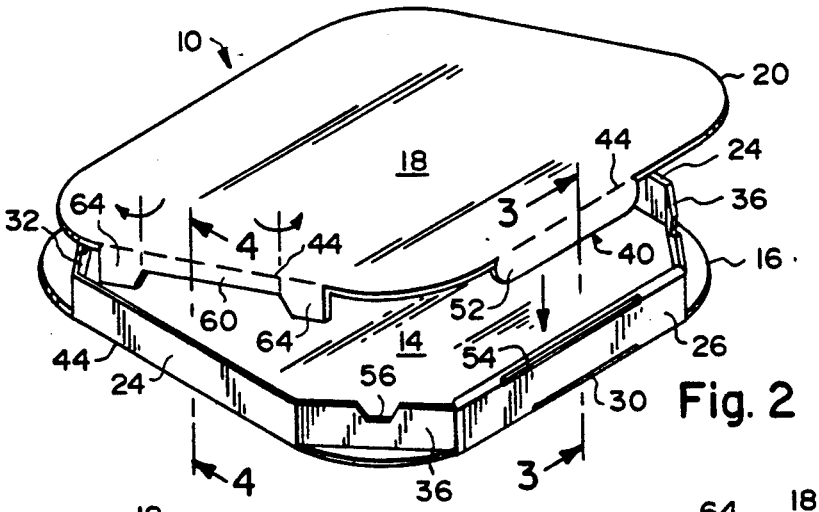
FIG. 2 is a perspective view of the instant invention after the blank has been folded with the top panel partially open.
Figure 3:
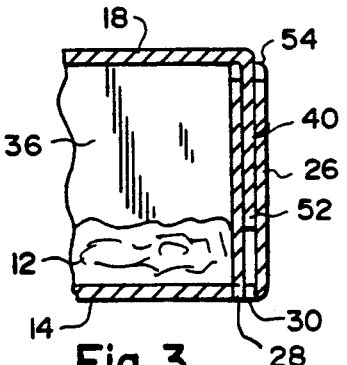
FIG. 3 is a cross sectional view with the top panel closed taken along line 3—3 in FIG. 2.
Figure 4:
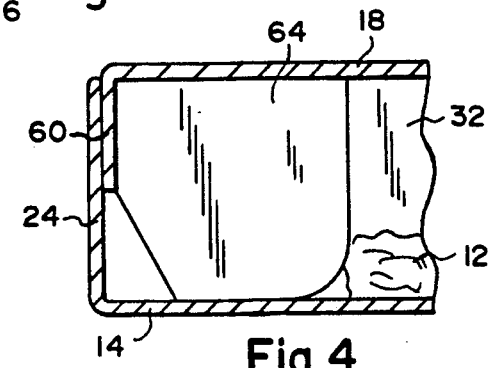
FIG. 4 is a cross sectional view with the top panel closed taken along line 4—4 in FIG. 2.

Turning now descriptively to the drawings, in which similar reference characters denote similar elements throughout the several views, the Figures illustrate a carton 10 for pizza 12 or the like, which consists of a bottom panel 14 having rounded safety corners 16 and a top panel 18 having rounded safety corners 20. A rear wall 22 that is hinged for connecting the bottom panel 14 and top panel 18 together. Two opposed side walls 24 are connected to and extend upwardly from the bottom panel 14. A fold over front wall 26 is connected to and extends upwardly from the bottom panel 14. The front wall 26 has an upper tab 28 and a lower slot 30, so that when folded over the lower slot 30 will receive the upper tab 28. A pair of rear diagonal corner walls 32 are each connected at one end to each side wall 24, so that a free end portion 34 can be manipulated to fit in front of the rear wall 22. A pair of front diagonal corner walls 36 are each connected at one end to each side wall 24, so that a free end portion 38 can be manipulated to fit in space between portions of the fold over front wall 26. A closure structure 40 is connected thereto for selectively maintaining the top panel 18 in a closed position.

The carton 10 is produced from a blank 42 of a substantially continuous sheet of durable material, having a plurality of score lines 44, tack points 46, punch out areas 48 and cut line 50, so that when folded and assembled an appropriate carton will be formed.

The closure structure 40 includes a front tongue 52 connected at a front edge score line 44 and extends downwardly from the top panel 18. The fold over front wall 28 has a middle slot 54, so that when folded over the middle slot 54 will be located at a top edge to receive the front tongue 52, when the top panel 18 is in the closed position.

Each rear diagonal wall 32 and front diagonal wall 36 has an air vent opening 56 therein, to allow heated air to escape from the carton 10. The carton 10 further contains two opposed inner side flaps 58 and 60, that are each connected at a side edge score line 44 to and extend downwardly from the top panel 18. A first pair of tabs 62, are each formed at opposite ends of the first inner side flap 58, so that if the first tabs 62 are optionally separated from tack points 46 at the score lines 44 and folded inwardly, they will engage with the pizza 12 or the like when the top panel 18 is in the closed position. A second pair of tabs 64 are each formed at opposite ends of the second inner side flap 60, so that if the second tabs 64 are also optionally separated from tack points 46 at the side edge score lines 44 and folded inwardly, they will engage with the pizza 12 or the like when the top panel 18 is in the closed position to prevent shifting thereof, when the carton 10 is being transported.

The carton 10 can be fabricated out of many different materials, typically but not limited to, corrugated cardboard, cardboard, plastic, pressed paper and the like. The carton 10 can also be made in different heights and sizes, so as to hold various types of food items ranging from tall cakes to flat pies.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A safety carton for pizza, formed from a blank of a substantially continuous sheet of durable material, which comprises:

a) a bottom panel having rounded safety corners;

b) a top panel having rounded corners:

c) a rear wall that is hinged to said bottom and top panels;

d) two opposed side walls connected to and extending upwardly from said bottom panel;

e) a fold over front wall connected to and extending upwardly from said bottom panel, said front wall having an upper tab and a lower slot, so that when folded over said lower slot will receive said upper tab;

f) a pair of rear diagonal corner walls, each connected at a first end to each said side wall, with a second end that can be manipulated to fit in front of said rear wall;

g) a pair of front diagonal corner walls, each connected at a first end to each said side wall, with a second end that can be manipulated to fit in a space formed in said fold over front wall; and h) closure means connected to said top panel and said front wall for selectively maintaining said top panel in a closed position.

2. A carton as recited in claim 1, wherein said closure means includes:

a) a front tongue connected to said top panel at a front edge score line and extending downwardly from said top panel; and b) said fold over front wall having a middle slot, so that when folded over said middle slot will be located at a top edge to receive said front tongue when said top panel is in the closed position.

3. A carton as recited in claim 2, wherein each said pair of rear diagonal walls and said pair of front diagonal walls, have an air vent opening therein to allow heated air to escape from said carton.

4. A carton as recited in claim 3, further including:

a) two opposed inner side flaps, each connected at a side edge score line to said top panel and extending downwardly from said top panel;

b) a first pair of tabs, each formed at opposite ends of a first inner side flap, so that when said first tabs are separated from tack points at the side edge score lines and folded inwardly, they will engage with the pizza when said top panel is in the closed position; and c) a second pair of tabs, each formed at opposite ends of a second inner side flap, so that when said second tabs are separated from tack points at the side edge score lines and folded inwardly, they will engage with the pizza when said top panel is in the closed position to prevent shifting thereof, when said carton is being transported.

* * * * *